US010248152B2

(12) United States Patent
Kim et al.

(10) Patent No.: US 10,248,152 B2
(45) Date of Patent: Apr. 2, 2019

(54) PEDAL APPARATUS AND MANUFACTURING METHOD THEREOF

(71) Applicants: Tyco Electronics AMP Korea Co., Ltd., Gyeongsangbuk-do (KR); Dong Hee Industrial Co., Ltd., Ulsan (KR)

(72) Inventors: Jun Woo Kim, Gyeongsangbuk-do (KR); Gap Pyo Hong, Gyeongsangbuk-do (KR); Young Woon Kim, Gyeongsangbuk-do (KR); Jung Min Lee, Busan (KR); Wi Sang Park, Gyeonggi-do (KR); Dong Hwan Kim, Ulsan (KR)

(73) Assignees: Dong Hee Industrial Co., Ltd., Ulsan (KR); Tyco Electronics AMP Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 15/913,103

(22) Filed: Mar. 6, 2018

(65) Prior Publication Data

US 2018/0253120 A1 Sep. 6, 2018

(30) Foreign Application Priority Data

Mar. 6, 2017 (KR) ..... 10-2017-0028253
Feb. 12, 2018 (KR) ..... 10-2018-0017298

(51) Int. Cl.
*G05G 1/38* (2008.04)
*G05G 1/44* (2008.04)
(Continued)

(52) U.S. Cl.
CPC ..... *G05G 1/38* (2013.01); *G05G 1/44* (2013.01); *G05G 1/46* (2013.01); *G05G 1/506* (2013.01); *G05G 5/05* (2013.01); *G05G 2505/00* (2013.01)

(58) Field of Classification Search
CPC .. G05G 1/30; G05G 1/38; G05G 1/44; G05G 1/445; G05G 1/46; G05G 1/506; G05G 5/05; G05G 2505/00
(Continued)

(56) References Cited

U.S. PATENT DOCUMENTS

2004/0149070 A1* 8/2004 Solta ..... B60K 26/02 74/513
2007/0151398 A1 7/2007 Kim
(Continued)

FOREIGN PATENT DOCUMENTS

DE 102006035882 A1 2/2008
DE 102010020314 A1 11/2011
(Continued)

OTHER PUBLICATIONS

Extended European Search Report, European Patent Application No. 18160080.0, dated Aug. 17, 2018, 7 pages.
(Continued)

*Primary Examiner* — Prasad V Gokhale
(74) *Attorney, Agent, or Firm* — Barley Snyder

(57) ABSTRACT

A pedal apparatus comprises a pedal housing including an inner space, a pedal pad configured to rotate relative to the pedal housing, a pedal arm connected to the pedal pad, a magnet installed in the pedal arm, and a sensing board. The pedal arm includes a hollow and is configured to rotate based on a rotation of the pedal pad. The sensing board has at least a portion inserted into the hollow and includes a hole sensor configured to sense a magnetic force generated by the magnet.

19 Claims, 14 Drawing Sheets

(51) Int. Cl.

| | |
|---|---|
| ***G05G 1/46*** | (2008.04) |
| ***G05G 5/05*** | (2006.01) |
| ***G05G 1/50*** | (2008.04) |

(58) Field of Classification Search
USPC ..... 74/512, 514, 560
See application file for complete search history.

(56) References Cited

U.S. PATENT DOCUMENTS

| | | | | |
|---|---|---|---|---|
| 2013/0305874 | A1* | 11/2013 | Fuller | G05G 1/44 74/513 |
| 2014/0238181 | A1* | 8/2014 | Kashiyama | F02D 11/02 74/513 |
| 2017/0313188 | A1* | 11/2017 | Saito | B60K 26/02 |
| 2018/0232002 | A1* | 8/2018 | Brown | G05G 1/40 |

FOREIGN PATENT DOCUMENTS

| | | | |
|---|---|---|---|
| EP | 1394650 | A1 | 3/2004 |
| EP | 1975760 | A2 | 10/2008 |
| KR | 1020150007792 | | 1/2015 |

OTHER PUBLICATIONS

English machine translation of DE 102010020314 A1, dated Nov. 17, 2011, 9 pages.
English machine translation of DE 102006035882 A1, dated Feb. 14, 2008, 11 pages.
Korean Office Action, dated Jan. 21, 2019, 7 pages.
Abstract of KR Application 102015007792, dated Jan. 21, 2015, 2 pages.

* cited by examiner

PEDAL APPARATUS AND MANUFACTURING METHOD THEREOF

CROSS-REFERENCE TO RELATED APPLICATIONS

This application claims the benefit of the filing date under 35 U.S.C. § 119(a)-(d) of Korean Patent Application No. 10-2017-0028253, filed on Mar. 6, 2017, and Korean Patent Application No. 10-2018-0017298, filed on Feb. 12, 2018.

FIELD OF THE INVENTION

The present invention relates to a pedal apparatus and, more particularly, to a pedal apparatus including electronic components.

BACKGROUND

A pedal apparatus, such as an accelerator pedal apparatus or a brake pedal apparatus, is installed in a vehicle. Mechanical components of the pedal apparatus are increasingly being replaced with electronic and communications components such as a sensor, an electric motor, and a field-bus; a mechanical throttle system of the accelerator pedal apparatus is replaced with an electronic throttle system (ETS).

The ETS electronically controls an acceleration of the vehicle and generally includes an accelerator pedal position sensor (APS) mounted on an accelerator pedal to transmit a press state and position information of the accelerator pedal to an electric control unit (ECU). The ECU calculates an amount of air to flow in an engine of the vehicle based on the press state and the position information of the accelerator pedal. The ECU transmits an instructed opening angle of a throttle valve to an electric throttle controller (ETC) based on a corresponding result to control a speed of the vehicle based on an acceleration requested by a driver. Because the ETS controls the speed of the vehicle based on information measured by the APS, the accuracy of the APS is critically important.

The above description is technical information that has been possessed or acquired by the inventor(s) in the process of conceiving the present invention and cannot be necessarily considered as well-known technology that had been known to the public before the filing of the present invention.

SUMMARY

A pedal apparatus comprises a pedal housing including an inner space, a pedal pad configured to rotate relative to the pedal housing, a pedal arm connected to the pedal pad, a magnet installed in the pedal arm, and a sensing board. The pedal arm includes a hollow and is configured to rotate based on a rotation of the pedal pad. The sensing board has at least a portion inserted into the hollow and includes a hole sensor configured to sense a magnetic force generated by the magnet.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
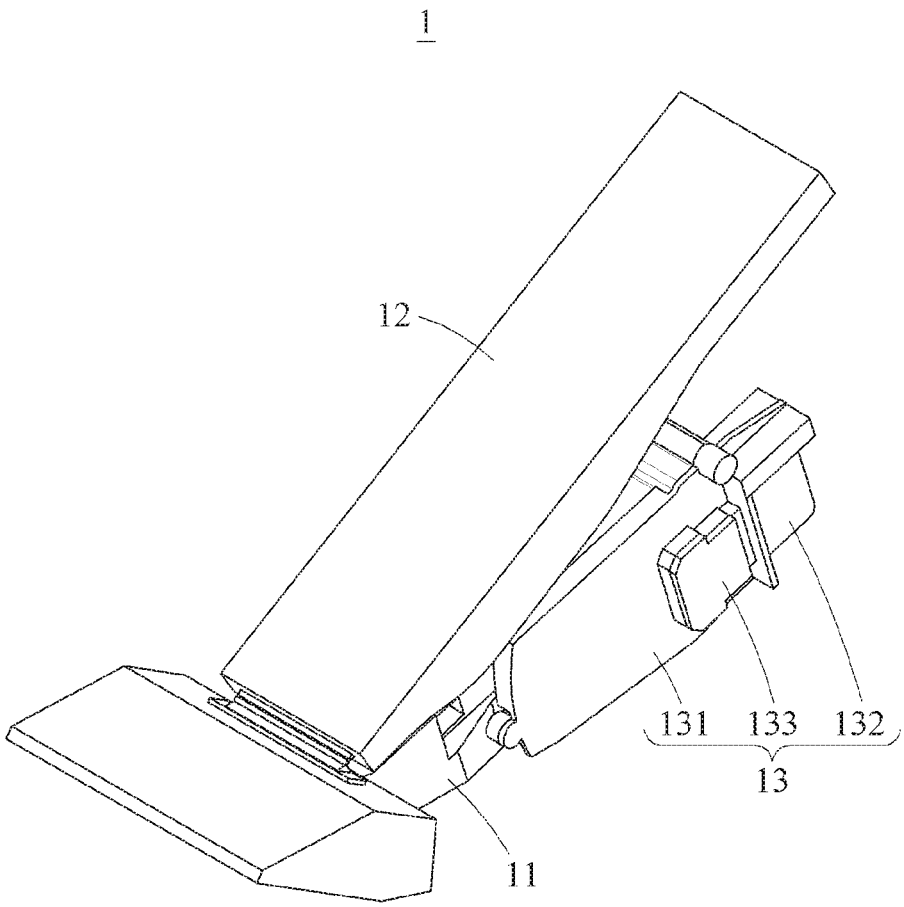
FIG. 1 is a perspective view of a pedal apparatus according to an embodiment.

Hereinafter, embodiments of the present disclosure will be described with reference to the accompanying drawings. Regarding the reference numerals assigned to the components in the drawings, it should be noted that the same components will be designated by the same reference numerals, wherever possible, even though they are shown in different drawings. Also, in the description of the embodiments, detailed description of well-known related structures or functions will be omitted when it is deemed that such description will cause ambiguous interpretation of the present disclosure.

Also, in the description of the components, terms such as first, second, A, B, (a), (b) or the like may be used herein when describing components of the present disclosure. Each of these terms is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

The same name may be used to describe a component included in an embodiment and a component having a common function in another embodiment. Unless otherwise mentioned, the description on the embodiment may be applicable to the other embodiment and thus, duplicated description will be omitted for conciseness.

Figure 10:
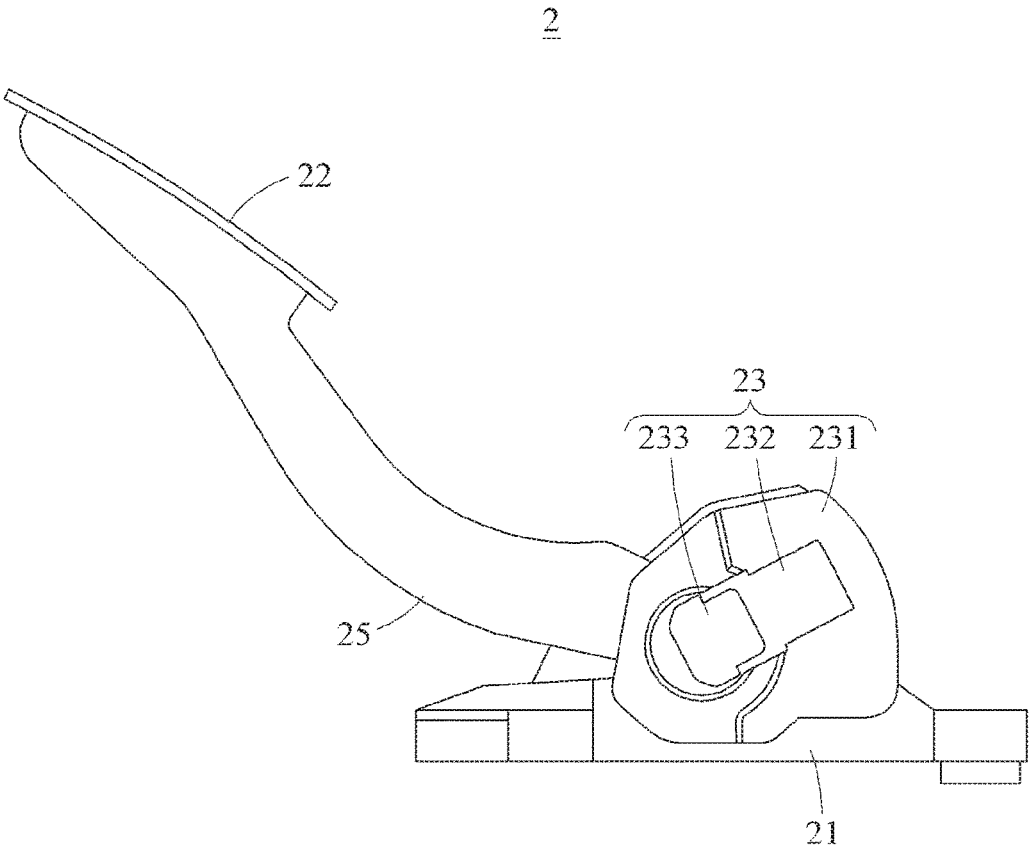
FIG. 10 is a side view of a pedal apparatus according to another embodiment.
Figure 11:
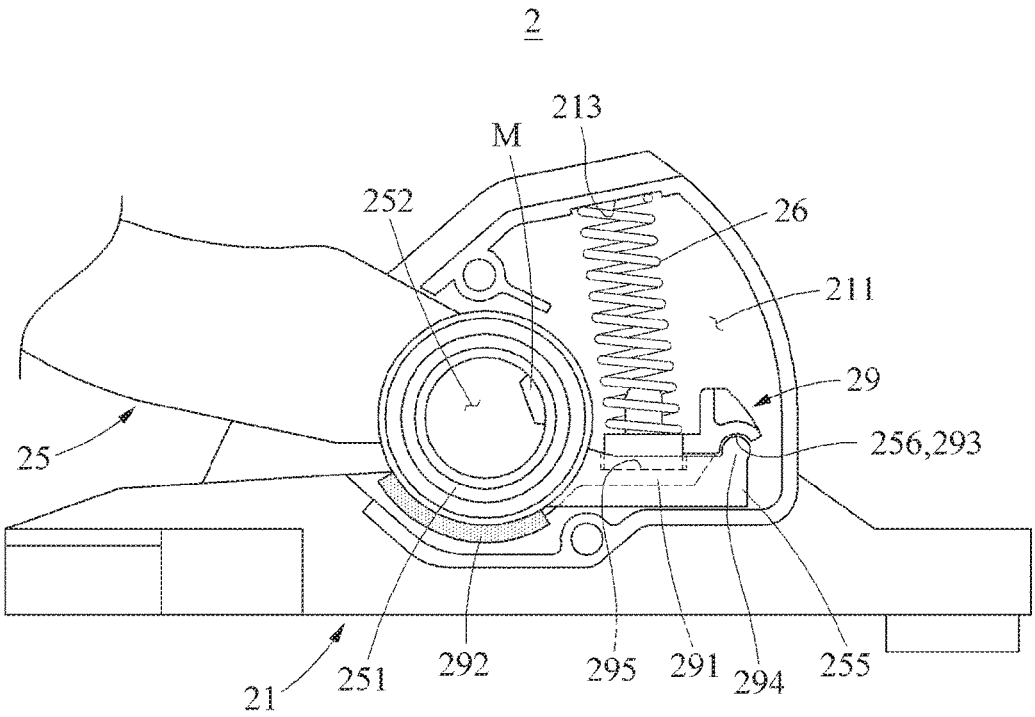
FIG. 11 is a side view of the pedal apparatus of FIG. 10 with a pedal cover removed.

A pedal apparatus 1 according to an embodiment is shown in FIGS. 1-9. The pedal apparatus 1 may be installed in a conveyance such as a vehicle. The pedal apparatus 1 is configured to sense how far a user presses a pedal pad 12 and transmit the corresponding information to a controller. In various embodiments, the pedal apparatus 1 may be an accelerator pedal apparatus or a brake pedal apparatus; the pedal apparatus 1 will be described exemplarily herein as an accelerator pedal apparatus. The pedal apparatus 1 is shown in FIGS. 1-9 as a box-type pedal apparatus but may alternatively be a pendant-type pedal apparatus as shown in FIGS. 10 and 11.

The pedal apparatus 1, as shown in FIGS. 1-9, includes a pedal housing 11, the pedal pad 12, a pedal cover 13, a connecting link 14, a pedal arm 15, a magnet M, an elastic member 16, a sensing board 17, a plurality of terminals 18, and a pressurizing member 19.

Figure 2:
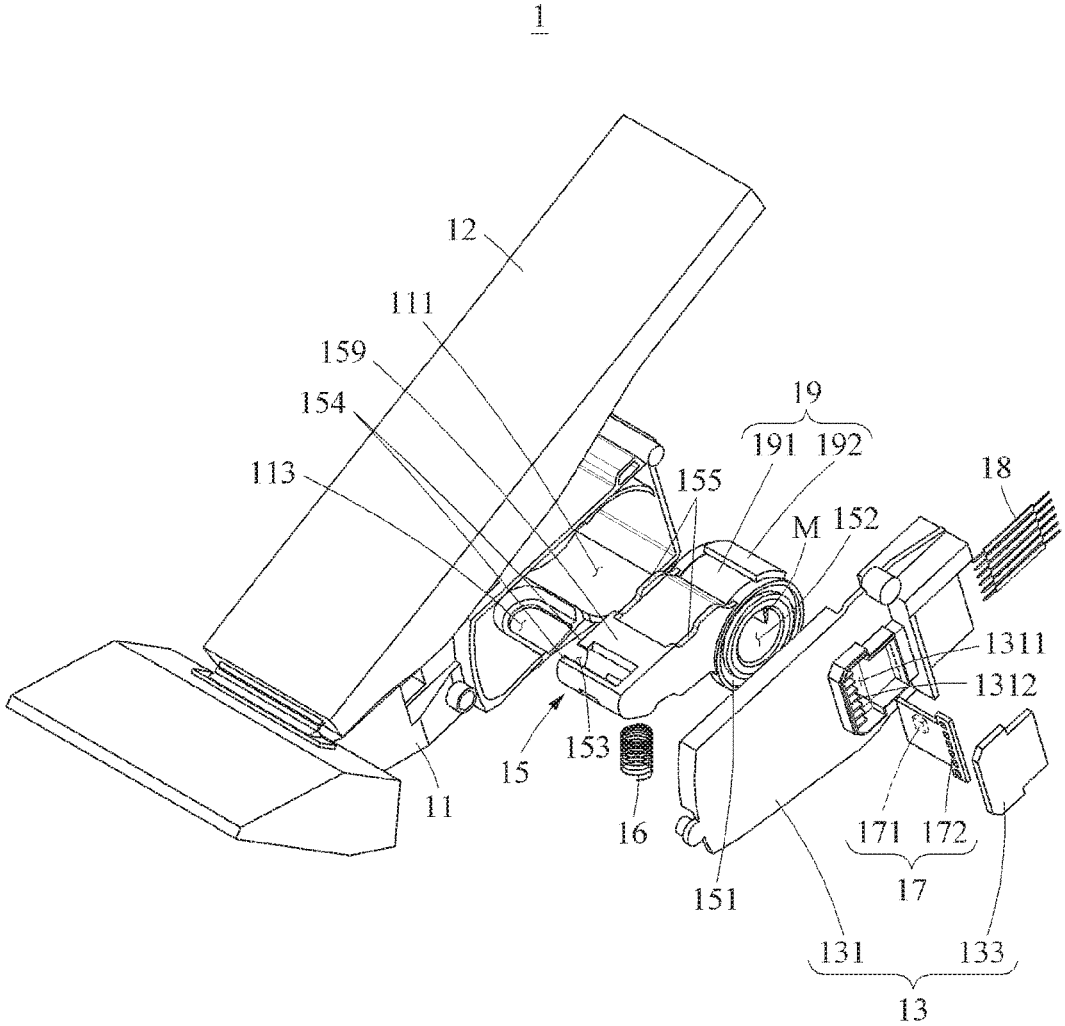
FIG. 2 is an exploded perspective view of the pedal apparatus.
Figure 4:
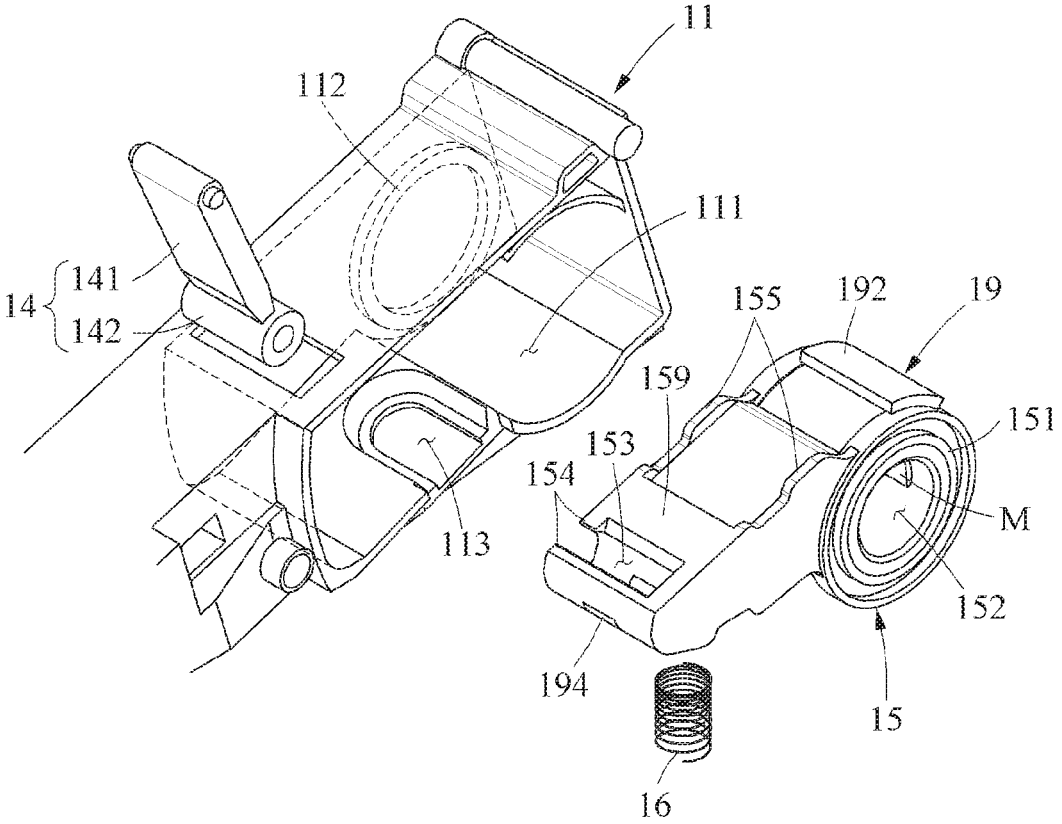
FIG. 4 is an exploded perspective view of a pedal arm and a pedal housing of the pedal apparatus.

The pedal housing 11, as shown in FIGS. 2 and 4, includes an inner space 111 configured to receive various components such as the pedal arm 15 and the elastic member 16, a first rotation guide ring 112, and a first receiving recess 113. The pedal housing 11 includes a top wall, a bottom wall, and a side wall, and the inner space 111 is opened toward a side opposite of the side wall. The first rotation guide ring 112 rotatably supports the pedal arm 15 and is disposed on an inner surface of the side wall of the pedal housing 11. The first rotation guide ring 112 may be, for example, a protrusion that protrudes from the side wall of the pedal housing 11. In another example, the first rotation guide ring 112 may be a groove that is recessed from the side wall of the pedal housing 11. The first receiving recess 113 is disposed on a lower inner surface of the pedal housing 11 and supports one end of the elastic member 16.

The pedal pad 12 may rotate relative to the pedal housing 11; as shown in FIG. 1, one side of the pedal pad 12 is rotatably connected to the pedal housing 11.

The pedal cover 13, as shown in FIGS. 1 and 2, is fastened to the pedal housing 11 and includes a cover body 131, a connector fastener 132, and a cover lid 133.

The cover body 131 shields the opened portion of the inner space 111 of the pedal housing 11, preventing an external foreign substance from entering the inner space 111. The cover body 131 includes a board insertion space 1311, a support rib 1312, a board box 1313, and a second rotation guide ring 1314 as shown in FIGS. 2 and 5.

The board insertion space 1311 is configured to receive the sensing board 17, and is recessed toward a hollow 152 of the pedal arm 15 as shown in FIG. 2. The board insertion space 1311 is exposed to an outside and the sensing board 17 is easily inserted.

The support rib 1312 may be formed on an inner surface of the board insertion space 1311 as shown in FIG. 2. The support rib 1312 prevents a board end part 17*b* shown in FIG. 3 from moving backward when the plurality of terminals 18 are fastened to the board end part 17*b* of the sensing board 17. A plurality of support ribs 1312 may be provided spaced apart from each other such that end portions of the terminals 18 passing through the board end part 17*b* may be inserted into an interval between the support ribs 1312, preventing the end portions of the terminals 18 from being obstructed by other members.

Figure 5:
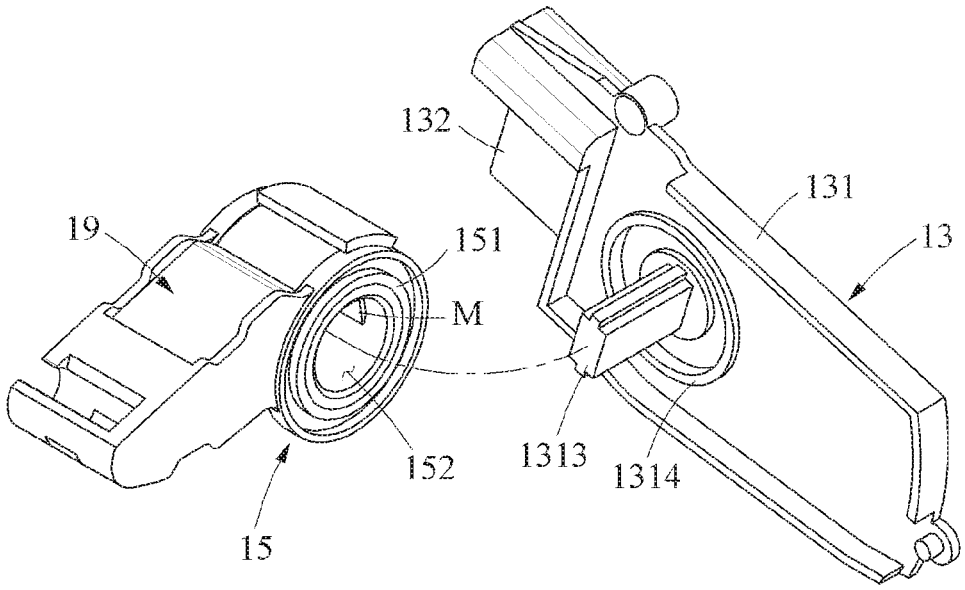
FIG. 5 is an exploded perspective view of the pedal arm and a pedal cover of the pedal apparatus.

The board box 1313, shown in FIG. 5, shields the board insertion space 1311 from the inner space 111 of the pedal housing 11. The board box 1313 thereby prevents a malfunction caused by fine particles generated by friction contacting the sensing board 17 when the pedal arm 15 operates in the inner space 111 of the pedal housing 11.

The second rotation guide ring 1314, shown in FIG. 5, rotatably supports the pedal arm 15. The second rotation guide ring 1314 and the first rotation guide ring 112 may be positioned opposite one another. The second rotation guide ring 1314 and the first rotation guide ring 112 are engaged with a pair of coupling rings 151 of the pedal arm 15. By the above structure, without employing a separate shaft structure that penetrates through the pedal arm 15, the pedal arm 15 is rotatably installed in the inner space 111 of the pedal housing 11. That is, a shaft structure that passes through the hollow 152 of the pedal arm 15 is unnecessary. The sensing board 17 may thereby be positioned in the hollow 152.

The connector fastener 132, shown in FIG. 5, is a portion to which an external connector to be electrically connected to the sensing board 17 is fastened. The external connector may be fastened to the connector fastener 132 and physically and electrically connected to the plurality of terminals 18 positioned in the connector fastener 132, thereby externally transmitting a signal sensed by a hole sensor 171 of the sensing board 17.

The cover lid 133, shown in FIG. 2, is fastened to the cover body 131 to shield the board insertion space 1311 from the outside, preventing a foreign substance from contacting the sensing board 17. The cover lid 133 is fixed to the cover body 131 using, for example, laser welding. Other forms of fixing the cover lid 133 to the cover body 131 may alternatively be used.

The connecting link 14, shown in FIG. 4, connects the pedal pad 12 and one end of the pedal arm 15 such that an angle of the pedal arm 15 may change based on a change in an angle of the pedal pad 12. The connecting link 14 includes a connecting body 141 rotatably connected to a bottom surface of the pedal pad 12 and a connecting head 142 formed at an end portion of the connecting body 141 and rotatably connected to the one end of the pedal arm 15. In an embodiment, a thickness of a portion of the connecting body 141 connected to the connecting head 142 is less than a thickness of the connecting head 142; this prevents a separation of the connecting link 14 from a connecting recess 153 of the pedal arm 15 without using a separate shaft structure.

Figure 8:
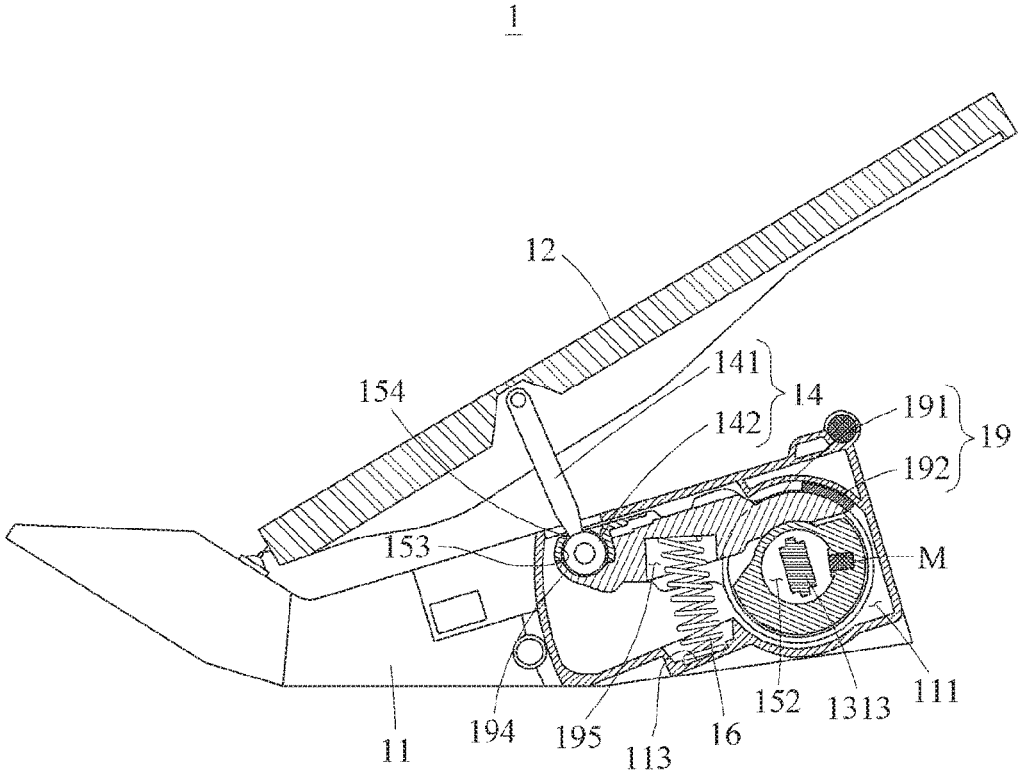
FIG. 8 is a sectional view of the pedal apparatus with a pedal pad in an upper position.

The pedal arm 15, as shown in FIGS. 2, 4, 8, and 9, is disposed in the inner space 111 of the pedal housing 11 and rotates based on an angle of rotation of the pedal pad 12; pedal arm 15 is connected indirectly to the pedal pad 12 through the connecting link 14 as shown in FIG. 8. The pedal arm 15 includes the pair of coupling rings 151, the hollow 152, the connecting recess 153, a separation preventing projection 154, a pair of guide plates 155, and a first support 156.

The pair of coupling rings 151, as shown in FIG. 4, are disposed at both ends of the hollow 15 and are respectively engaged with the first rotation guide ring 112 and the second rotation guide ring 1314 such that the pedal arm 15 may rotate about a predetermined rotation axis.

The hollow 152 penetrates through the pedal arm 15, as shown in FIGS. 2 and 4-9. In various embodiments, the hollow 152 may have a cylindrical shape, may be a hole having another shape, or may be a cavity that is recessed from one surface of the pedal arm 15. The hollow 152 provides a space in which the sensing board 17 is positioned. When the pedal apparatus 1 is assembled, the hollow 152 is disposed at a central portion of the pedal housing 11, that is, at a position sufficiently spaced apart from the outside. Thus, the sensing board 17 positioned in the hollow 152 is not influenced by disturbances, increasing an accuracy of measuring the angle of rotation of the pedal pad 12. In addition, the sensing board 17 is typically installed on an outer wall of the pedal apparatus 1, which prevents magnetic fields generated by external electronic components from affecting the sensing board 17; in an embodiment, a sufficient air gap is formed between the sensing board 17 and the external space. The inner space 111 of the pedal housing 11 functions as the air gap and the formation of a separate air gap is not required, reducing the overall volume of the pedal apparatus 1.

The connecting recess 153, as shown in FIGS. 2 and 4, is a recess into which the connecting head 142 is inserted. The connecting recess 153 is formed at the one end of the pedal arm 15 in a cylindrical shape with a size and a diameter corresponding to the connecting head 142. An upper side of the connecting recess 153 is open such that the connecting body 141 extending from the connecting head 142 is exposed. The separation preventing projection 154 is disposed on at least a portion of the opened upper side of the connecting recess 153 to support an upper side of the connecting head 142 such that the connecting head 142 laterally inserted into the connecting recess 153 may not be separated upward.

The pair of guide plates 155 form both side surfaces of the pedal arm 15 as shown in FIGS. 2 and 4. The pressurizing member 19, described in greater detail below, is disposed between the pair of guide plates 155. The guide plates 155 prevent a separation of the pressurizing member 19 from the pedal arm 15 and guide the pressurizing member 19 to stably rotate with respect to the pedal arm 15.

Figure 6:
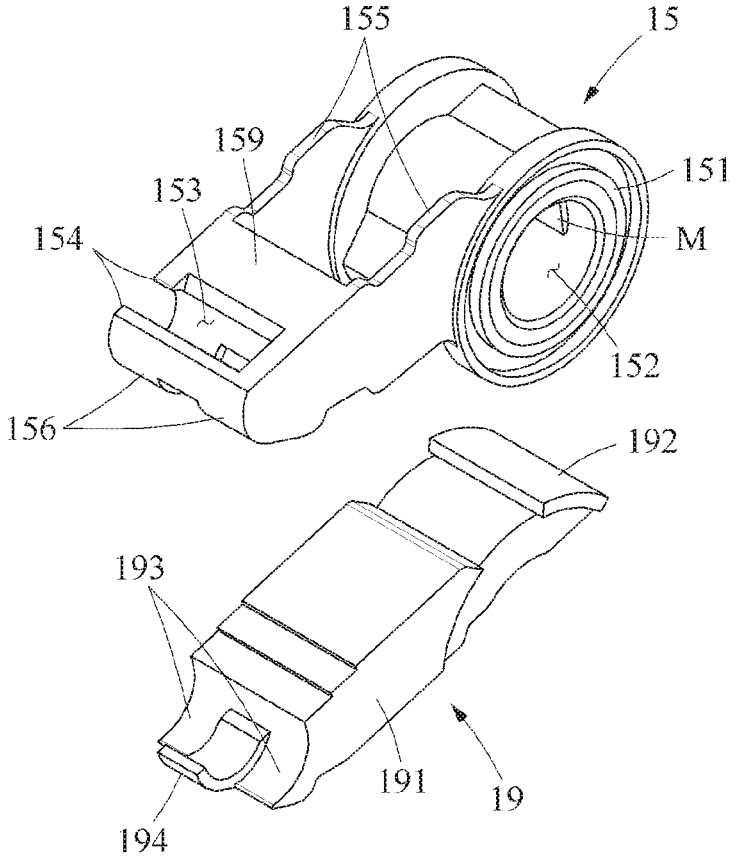
FIG. 6 is an exploded perspective view of the pedal arm and a pressurizing member of the pedal apparatus.

The first support 156, as shown in FIG. 6, is a curved surface formed on a bottom surface of the one end of the pedal arm 15. The first support 156 supports one end of the pressurizing member 19. In an embodiment, the first support 156 is construed as a portion of the bottom surface of the connecting recess 153.

The elastic member 16, as shown in FIGS. 2, 4, 8, and 9, is disposed between a middle part of the pressurizing member 19 and the lower inner surface of the pedal housing 11. The elastic member 16 provides an elastic force pressing the pressurizing member 19 upward and thus provides the elastic force to rotate the pedal pad 12 in a direction away from the pedal housing 11.

The magnet M may be installed in the pedal arm 15 as shown in FIGS. 2-9. The magnet M may be fixed and installed in the pedal arm 15 using insert injection in a process of manufacturing the pedal arm 15. In the shown embodiment, the magnet M is installed on a surface of the inner wall of the hollow 152 and the magnet M is exposed through the hollow 152. In this exemplary embodiment, the magnet M is positioned closer to the sensing board 17 when compared to a case in which the magnet M is installed to be mounted in the pedal arm 15, such that the magnet M is not be exposed through the hollow 152. Thus, a strength of a magnetic field generated by the magnet M and sensed by the sensing board 17 is increased. In another embodiment the pedal apparatus 1 may include a plurality of magnets M. By employing magnets that generate relatively strong magnetic fields, for example, rare earth magnets, particularly, neodymium magnets, sizes and quantities of the magnets may be reduced. A plurality of magnets with relatively high supply and price stability, for example, ferrite magnets, may be used. As described above, the types and the number of the magnets M may vary in different embodiments.

Figure 3:
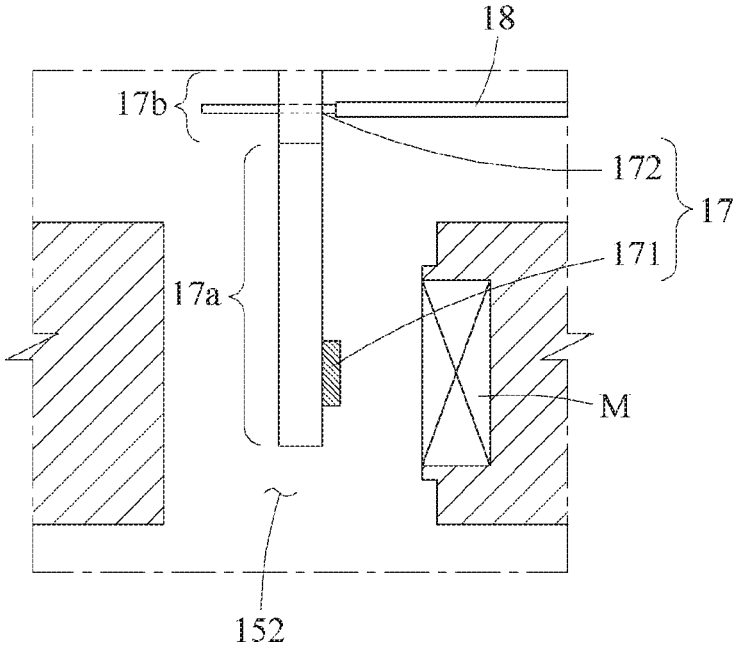
FIG. 3 is a sectional view of a sensing board and a magnet of the pedal apparatus.

The sensing board 17 transmits information related to the angle of rotation of the pedal pad 12 to the outside through the terminals 18. At least a portion of the sensing board 17 is inserted into the hollow 152 as shown in FIG. 3. The sensing board 17 includes the hole sensor 171 configured to sense a magnetic force generated by the magnet M and a terminal fastening hole 172 through which the plurality of terminals 18 are fastened thereto. The sensing board 17 is divided into a board main part 17*a* on which the hole sensor 171 is installed and the board end part 17*b* including the terminal fastening hole 172. A width of the board end part 17*b* may be greater than a width of the board main part 17*a* such that the sensing board 17 may not be inserted into the board insertion space 1311 in excess of a predetermined length. The hole sensor 171 is positioned in the hollow 152, for example, on the rotation axis of the pedal arm 15 as shown in FIG. 3. The hole sensor 171 senses a change in the magnetic field generated by the magnet M and senses an amount of rotation of the pedal arm 15 to which the magnet M is fixed.

The plurality of terminals 18, as shown in FIGS. 2 and 3, are positioned in the connector fastener 132 and are electrically connected to the external connector fastened to the connector fastener 132. The plurality of terminals 18 are installed in a direction perpendicular to the sensing board 17 and are inserted through the connector fastener 132. The terminals 18 are press fit on the sensing board 17. In a case in which a terminal of a connecting fastener and a sensing board are in parallel, a conductive elastic body may be needed to guarantee a connection between the terminal of the connector fastener and the sensing board, and the connector fastener may need to be manufactured as a separate component. In the embodiments described herein, however, the connector fastener 132 and the cover body 131 may be monolithically formed using injection molding, reducing the number of components and manufacturing costs. Further, a coupling force of the sensing board 17 and the terminals 18 is improved without using a separate medium. An oscillation horizontally applied to the sensing board 17 may be attenuated by the terminals 18 and an oscillation horizontally applied to the terminals 18 may be attenuated by the sensing board 17.

The pressurizing member 19 presses the inner wall of the pedal housing 11 when the user controls the pedal pad 12. The one end of the pressurizing member 19 is supported by a lower side of the one end of the pedal arm 15 and an opposite end of the pressurizing member 19 is positioned between an upper inner surface of the pedal housing 11 and the hollow 152 of the pedal arm 15 as shown in FIGS. 2 and 4.

Figure 7:
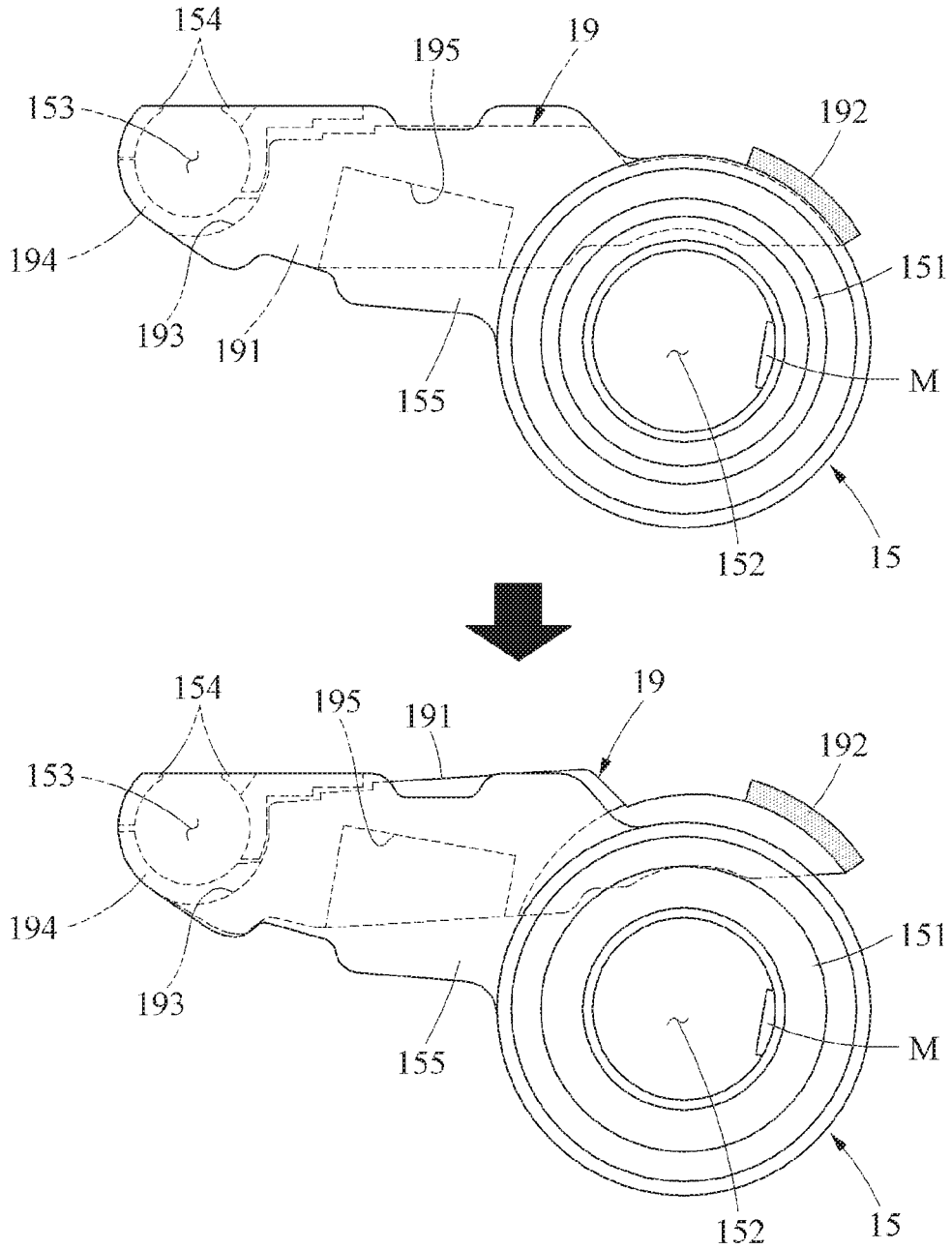
FIG. 7 is a side view of the pressurizing member rotating with respect to the pedal arm.

The pressurizing member 19, as shown in FIGS. 6 and 7, includes a pressurizing lever 191 configured to rotate with respect to the pedal arm 15, a second support 193 positioned at one end of the pressurizing lever 191, a friction pad 192 positioned at another end of the pressurizing lever 191, a stopping projection 194 to be stopped by an end portion of the pedal arm 15 such that the pressurizing lever 191 may not be separated from the pedal arm 15, and a second receiving recess 195 formed on a bottom surface of the pressurizing lever 191 to support another end of the elastic member 16.

The friction pad 192 is a member that produces friction when rubbed against the inner wall of the pedal housing 11, and may include, for example, a material having a higher frictional coefficient than the pressurizing lever 191.

The second support 193 is a curved surface formed on a top surface of the one end of the pressurizing member 19 and supports a lower end of an outer circumferential surface of the first support 156 of the pedal arm 15. The second support 193 has the same or similar curvature as the first support 156 and supports the pedal arm 15 such that the pressurizing member 19 rotates with respect to the pedal arm 15 as shown in FIG. 7. In an embodiment, a pair of second supports 193 may be disposed on opposite sides of the stopping projection 194.

Figure 9:
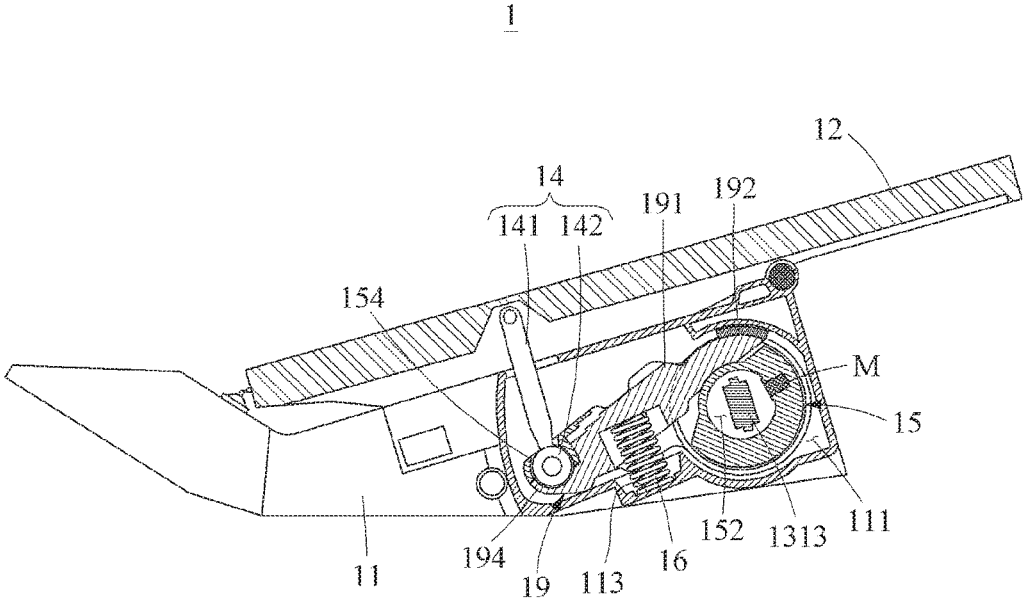
FIG. 9 is a sectional view of the pedal apparatus with the pedal pad in a lower position.

As shown in FIGS. 8 and 9, when the user presses the pedal pad 12, the one end of the pedal arm 15 rotates downward and the elastic member 16 is compressed such that an elastic force increases and a reaction force applied to the pressurizing member 19 also increases. Here, since the pedal arm 15 and the pressurizing member 19 are separated from each other, the reaction force by the elastic member 16 is concentrated on the pressurizing member 19 such that the friction pad 192 at the other end of the pressurizing member 19 rubs against the inner surface of the pedal housing 11 with an increased frictional force. Because the pressurizing member 19 is separated from the pedal arm 15, a load generated as the pedal pad 12 is pressed is concentrated on the friction pad 192 rather than the pair of rotation guide rings 112 and 1314 supporting the pedal arm 15. The frictional force of the friction pad 192 increases while abrasion of the rotation guide rings 112 and 1314 and the coupling rings 151 is minimized. A movement of the pedal arm 15 from the rotation guide rings 112 and 1314 is thereby prevented and a value measured by the sensing board 17 may be stably output.

When the user releases the pedal pad 12, the one end of the pedal arm 15 rotates and returns to the original upper position shown in FIG. 8 by the elastic force of the elastic member 16. The compressed elastic member 16 is restored such that the elastic force gradually decreases and the reaction force applied to the pressurizing member 19 also decreases. The elastic force used to restore the elastic member 16 assists the pedal arm 15 to move upward and the frictional force with which the friction pad 192 rubs against the inner surface of the pedal housing 11 decreases.

A hysteresis between a pressing force and a releasing force with respect to the pedal pad 12 may occur. The pressurizing member 19 configured to rotate relative to the pedal arm 15 rubs against the inner surface of the pedal housing 11, increasing the frictional force and also causing the hysteresis. The number of components of the pedal apparatus may be reduced and production costs may also be reduced.

A method of manufacturing the pedal apparatus 1 includes manufacturing a pedal cover 13 by forming the cover body 131 and the connector fastener 132 monolithically using injection molding, inserting a sensing board 17 including a hole sensor 171 from an outside in a direction perpendicular to a surface of the pedal cover 13 such that the hole sensor 171 is positioned in a hollow 152 of a pedal arm 15, and inserting a plurality of terminals 18 configured to transmit a signal sensed by the hole sensor 171 to the outside in a direction perpendicular to the sensing board 17 such that the plurality of terminals 18 are installed on the sensing board 17.

Before the cover lid 133 is installed, the sensing board 17 may be inserted and installed in the board insertion space 1311 in a direction parallel to the rotation axis of the pedal arm 15. Further, when the sensing board 17 is installed, the plurality of terminals 18 may be inserted in a direction perpendicular to the rotation axis of the pedal arm 15 and fastened to the sensing board 17 through the connector fastener 132.

A pedal apparatus 2 according to another embodiment is shown in FIGS. 10 and 11. The pedal apparatus 2 includes a pedal housing 21, a pedal pad 22, a pedal cover 23, a pedal arm 25, a magnet M, an elastic member 26, a sensing board, a plurality of terminals, and a pressurizing member 29.

The pedal housing 21 includes a hole through which the pedal arm 25 passes such that the pedal arm 25 extends to be connected to the pedal pad 22. The pedal housing 21 includes an inner space 211, a first rotation guide ring, and a first receiving recess 213. The first receiving recess 213, as shown in FIG. 11, is provided on an upper inner surface of the pedal housing 21 to support an upper end of the elastic member 26.

The pedal pad 22 is connected directly to the pedal arm 25, for example, without using a separate connecting link, and transmits a pedal force of a user to the pedal arm 25.

The pedal cover 23 includes a cover body 231, a connector fastener 232, and a cover lid 233 as shown in FIG. 10. Similar to the embodiment described above with reference to FIGS. 1-9, the cover body 231 includes a board insertion space, a support rib, a board box, and a second rotation guide ring.

The pedal arm 25 includes a pair of coupling rings 251, a hollow 252, a pair of guide plates 255, and a first support 256 as shown in FIG. 11. The first support 256 is a curved surface formed on a top surface of one end of the pedal arm 25 and supports one end of the pressurizing member 29.

The elastic member 26 is disposed between a middle part of the pressurizing member 29 and the upper inner surface of the pedal housing 21. The elastic member 26 provides an elastic force to press the pressurizing member 29 downward and move the pedal pad 22 upward.

The sensing board includes a hole sensor and a terminal fastening hole. The sensing board is divided into a board main part on which the hole sensor is installed and a board end part including the terminal fastening hole.

The pressurizing member 29 includes a pressurizing lever 291, a second support 293, a friction pad 292, and a second receiving recess 295 as shown in FIG. 11. The second support 293 is a curved surface formed on a bottom surface of the one end of the pressurizing member 29 and supports an upper end of an outer circumferential surface of the first support 256 of the pedal arm 25. The second receiving recess 295 is formed on a top surface of the pressurizing lever 291 to support a lower end of the elastic member 26.

Figure 12:
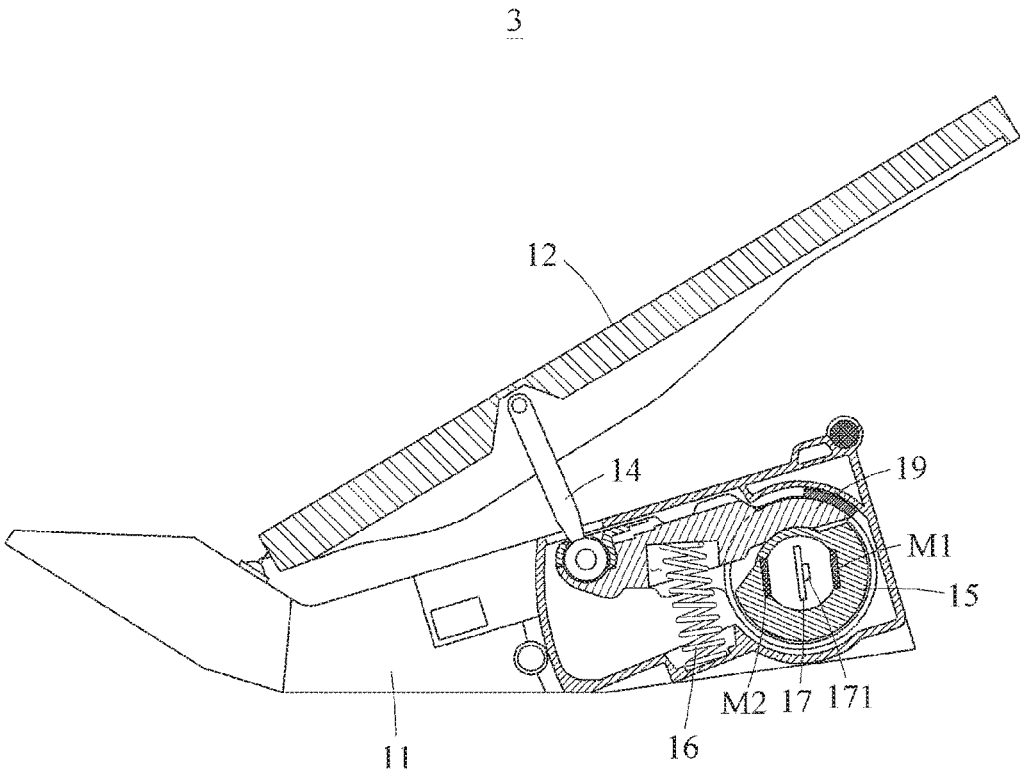
FIG. 12 is a sectional view of a pedal apparatus according to another embodiment.
Figure 13A:
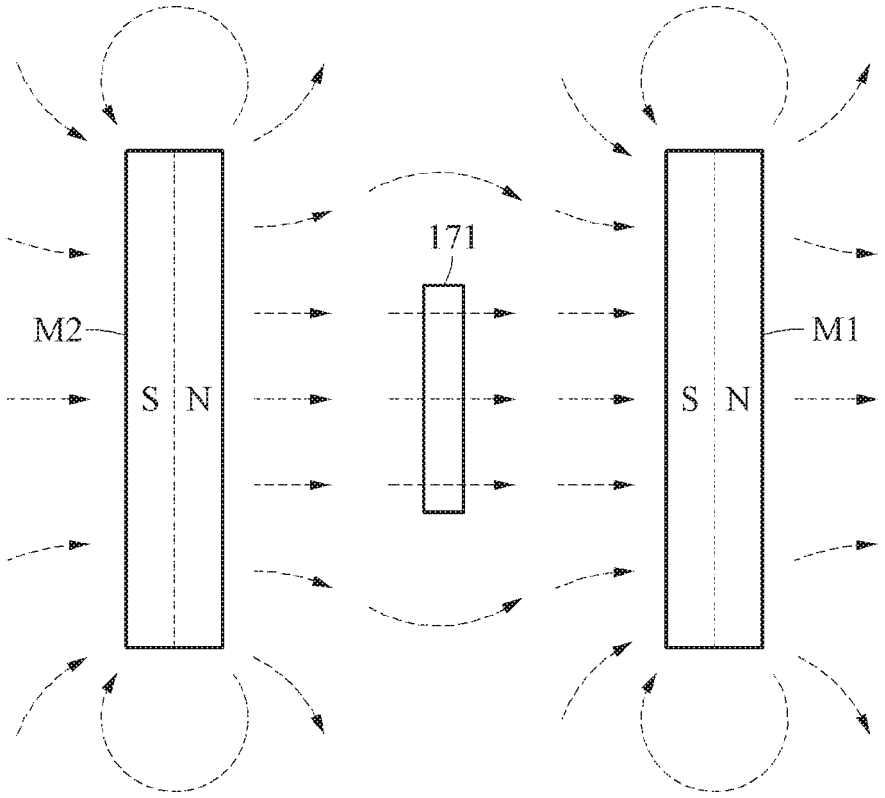
FIG. 13A is a schematic view of a distribution of magnetic force lines formed by a pair of magnets of the pedal apparatus of FIG. 12 in a first position.
Figure 13B:
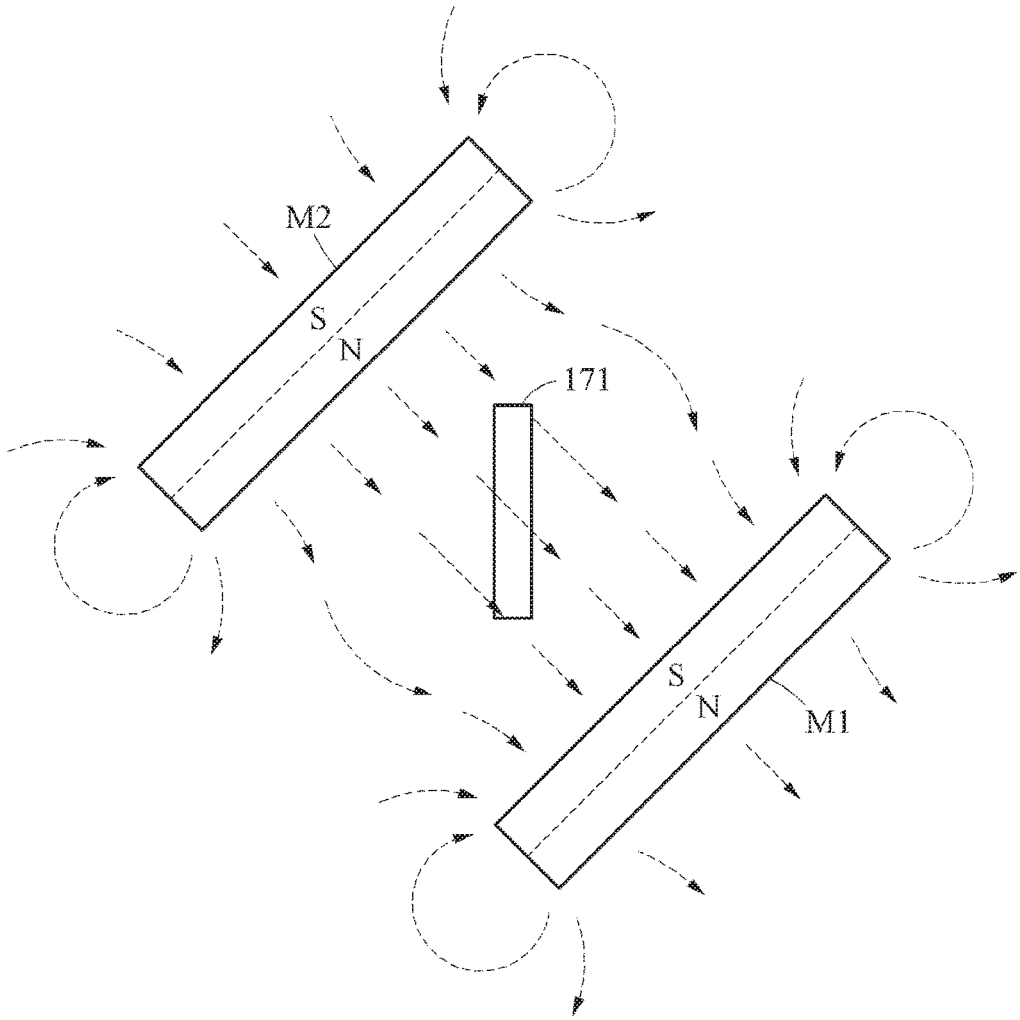
FIG. 13B is a schematic view of a distribution of magnetic force lines formed by the pair of magnets of the pedal apparatus of FIG. 12 in a second position.

A pedal apparatus 3 according to another embodiment is shown in FIGS. 12, 13A, and 13B. The pedal apparatus 3 includes include a pair of magnets M1 and M2 positioned on opposite sides of the hole sensor 171 of the sensing board 17. The pair of magnets M1 and M2 may be disposed such that facing surfaces thereof have opposite magnetisms.

Nearly linear magnetic force lines are formed in a space between the pair of magnets M1 and M2, as shown in FIGS. 13A and 13B. The hole sensor 171 senses a change in directions of the magnetic force lines, thereby sensing a change in an angle of the pedal arm 15. Due an error occurring in a process of manufacturing and assembling the pedal apparatus 3, for example, the hole sensor 171 may be disposed at a position other than a set position. If a single magnet is provided, an effect of a magnetic field formed by the single magnet on the hole sensor 171 in response to a change in the angle of the pedal arm 15 may differ from what is expected. That is, in a case in which the position of the hole sensor 171 changes in upward/downward/leftward/rightward directions due to an assembly tolerance when the pedal arm 15 operates, the effect on the hole sensor 171 in response to the change in the angle of the pedal arm 15 may be different from what is expected. Such a difference may decrease an accuracy of measuring the angle of the pedal pad 12. However, in the embodiment of FIGS. 12 and 13, although the position of the hole sensor 171 is apart from the set position in upward/downward/leftward/rightward directions, the directions of the magnetic force lines formed in the space between the pair of magnets M1 and M2 may scarcely change. Thus, despite the error occurring in the process of manufacturing and assembling the pedal apparatus 3, the angle of the pedal pad 12 may be measured accurately.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A pedal apparatus, comprising:

a pedal housing including an inner space;

a pedal pad configured to rotate relative to the pedal housing;

a pedal arm connected directly or indirectly to the pedal pad and including a hollow, the pedal arm configured to rotate based on a rotation of the pedal pad;

a magnet installed in the pedal arm; and a sensing board having at least a portion inserted into the hollow and including a hole sensor configured to sense a magnetic force generated by the magnet.

2. The pedal apparatus of claim 1, further comprising a pedal cover including a cover body configured to shield the inner space of the pedal housing.

3. The pedal apparatus of claim 2, wherein the pedal arm includes a pair of coupling rings respectively disposed at each of two opposite ends of the hollow, the pair of coupling rings are engaged with a first rotation guide ring formed on an inner surface of the pedal housing and a second rotation guide ring formed on an inner surface of the cover body such that the pedal arm rotates about a rotation axis.

4. The pedal apparatus of claim 3, wherein the hole sensor is positioned on the rotation axis.

5. The pedal apparatus of claim 3, wherein the cover body includes a board insertion space recessed toward the hollow and a board box configured to shield the board insertion space from the inner space of the pedal housing.

6. The pedal apparatus of claim 5, wherein the pedal cover includes a connector fastener to which a connector is fastened, the connector is electrically connected to the sensing board to externally transmit a signal sensed by the hole sensor.

7. The pedal apparatus of claim 6, further comprising a plurality of terminals electrically connected to the connector, positioned in the connector fastener, and extending in a direction perpendicular to the sensing board.

8. The pedal apparatus of claim 7, wherein the connector fastener and the cover body are formed as a monolithic body.

9. The pedal apparatus of claim 8, wherein the sensing board includes a board main part on which the hole sensor is installed and a board end part including a terminal fastening hole through which the plurality of terminals are fastened to the sensing board.

10. The pedal apparatus of claim 9, wherein a width of the board end part is greater than a width of the board main part and limits an insertion depth of the sensing board into the board insertion space.

11. The pedal apparatus of claim 10, wherein the pedal cover includes a support rib formed on an inner surface of the board insertion space, the support rib configured to prevent the board end part from moving backward when the plurality of terminals are fastened to the board end part.

12. The pedal apparatus of claim 8, wherein the pedal cover includes a cover lid configured to shield the board insertion space from the outside.

13. The pedal apparatus of claim 3, further comprising:

a connecting link configured to connect the pedal pad and a first end of the pedal arm;

a pressurizing member with a first end supported by a lower side of the first end of the pedal arm, an opposite second end of the pressurizing member provided between an upper inner surface of the pedal housing and the rotation axis; and an elastic member disposed between a middle part of the pressurizing member and a lower inner surface of the pedal housing.

14. The pedal apparatus of claim 3, further comprising:

a pressurizing member having a first end supported by an upper side of one end of the pedal arm and a second end opposite the first end provided between a lower inner surface of the pedal housing and the rotation axis; and an elastic member disposed between a middle part of the pressurizing member and an upper inner surface of the pedal housing.

15. The pedal apparatus of claim 1, wherein the magnet includes a pair of magnets positioned on opposite sides of the hole sensor and facing surfaces of the pair of magnets have opposite magnetisms.

16. A method of manufacturing a pedal apparatus, comprising:

providing a pedal pad, a pedal housing, a pedal arm installed in an inner space of the pedal housing, the pedal arm configured to rotate in response to an operation of the pedal pad, and a pedal cover configured to shield the inner space of the pedal housing;

inserting a sensing board including a hole sensor from an outside in a direction perpendicular to a surface of the pedal cover such that the hole sensor is positioned in a hollow of the pedal arm; and inserting a plurality of terminals in a direction perpendicular to the sensing board and installing the plurality of terminals on the sensing board, the terminals configured to externally transmit a signal sensed by the hole sensor.

17. The method of claim 16, wherein the plurality of terminals are press fit on the sensing board.

18. The method of claim 16, wherein the pedal cover includes a connector fastener to which a connector is fastened, the connector is electrically connected to the sensing board to externally transmit the signal sensed by the hole sensor.

19. The method of claim 18, wherein the plurality of terminals are inserted through the connector fastener and installed on the sensing board.

* * * * *